US005562150A

United States Patent [19]

Shimmell

[11] Patent Number: 5,562,150

[45] Date of Patent: Oct. 8, 1996

[54] DIE CASTING VENT

[75] Inventor: Dennis S. Shimmell, Hudsonville, Mich.

[73] Assignee: Nelson Metal Products Corporation, Grandville, Mich.

[21] Appl. No.: 534,878

[22] Filed: Sep. 27, 1995

[51] Int. Cl.[6] ..... B22D 17/20

[52] U.S. Cl. ..... 164/305; 164/410

[58] Field of Search ..... 164/113, 305, 164/410

[56] References Cited

U.S. PATENT DOCUMENTS 4,352,388 10/1982 Perrella ..... 164/305

FOREIGN PATENT DOCUMENTS 57-81949 5/1982 Japan ..... 164/305
61-38768 2/1986 Japan ..... 164/305
63-256238 10/1988 Japan ..... 164/305
5-200520 8/1993 Japan ..... 164/305

*Primary Examiner*—J. Reed Batten, Jr.
*Attorney, Agent, or Firm*—Warner Norcross & Judd

[57] ABSTRACT

The vent includes a plurality of passages formed by a plurality of stacked plates. The passages are dimensioned to permit the free flow of air but to prohibit the passage of molten metal. During die casting, air is free to exit the die while molten metal is retained.

2 Claims, 3 Drawing Sheets

DIE CASTING VENT

BACKGROUND OF THE INVENTION

The present invention relates to die casting, and more particularly to apparatus permitting air, but not metal, to exit a die casting die.

Die casting is frequently used as a method for forming articles from molten metal and metal alloys. Typically, two or more die parts are provided such that, when brought together, they form one or more cavities which defines the shape of the articles to be cast. Molten metal is introduced into the cavity and allowed to cool or "freeze." If desired, the metal may be squeeze-cast under high pressure, particularly to yield a heat treatable or weldable casting. Following casting, the die parts are opened and the cast articles are removed.

Typically, the molten metal is introduced into the die by means of a shot sleeve. The introduction of metal is referred to as a "pour" or "shot." The die defines a flow way or flow path through the cavities from the shot sleeve to an exit. As the metal is injected into the die, air exits the die through the exit. Particularly in squeeze casting and other high-pressure techniques, the exit must be closed at the end of the pour to prevent metal from passing through the exit.

Two techniques are generally accepted for closing the exit to the passage of metal. The first technique is the "Hodler System," including a valve that closes when the molten metal comes in contact with the valve. Consequently, air is free to exit the vent until the molten metal reaches the valve, at which time the valve closes.

The second technique is the "Turner System," including a mechanical valve that is closed in response to system timing when the metal is expected to arrive at the valve.

Both valves have disadvantages. First, they are relatively complicated and therefore expensive. Second, like any device with moving parts, the valves are less than perfectly reliable. Third, the Turner System is subject to sensor, timing, and control errors.

SUMMARY OF THE INVENTION

The aforementioned problems are overcome in the present invention comprising a die casting vent with no moving parts that permits the free passage of air but not molten metal. More particularly, the vent defines a plurality of passageways, each of which is sufficiently large to permit the passage of air, but sufficiently small to prohibit the passage of molten metal. Most preferably, the passages are elongated with a limited width and up to an unrestricted length. The width is selected to be no larger than the maximum width through which the molten metal can pass.

In the specifically disclosed embodiment, the vent is designed for use with the die casting of aluminum alloys; and the width of the passages is approximately one-hundredth (0.010) inch. The width will of course depend on the particular metal alloy.

The present invention includes no moving parts and therefore has improved reliability over known techniques. The vent freely permits the passage of air during the pour. However, the vent will not permit metal to pass through. Consequently, the vent is well suited to squeeze casting and other high-pressure casting operations.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 1:
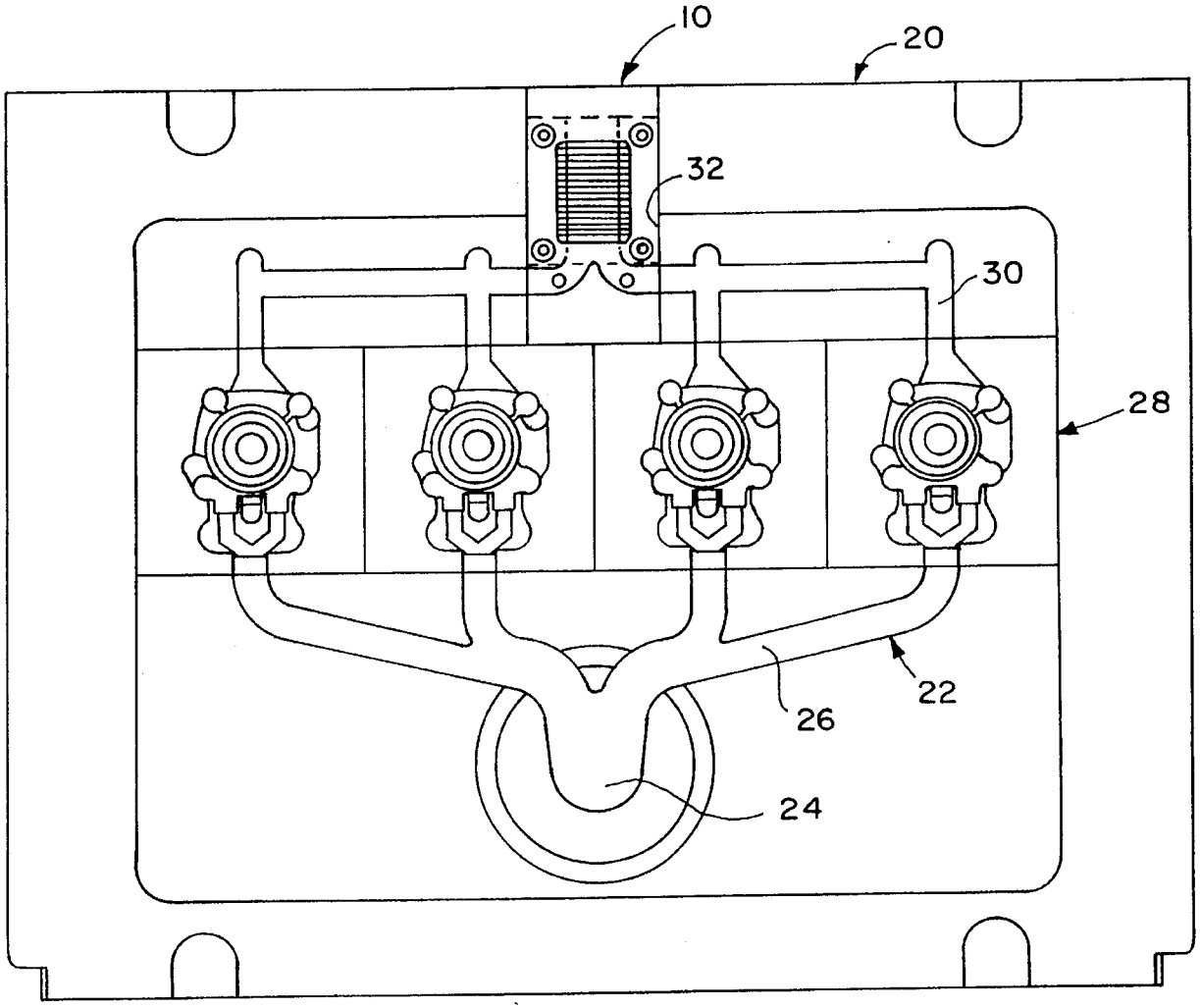
FIG. 1 is an elevational view of an ejector die with the vent of the present invention installed.
Figure 2:
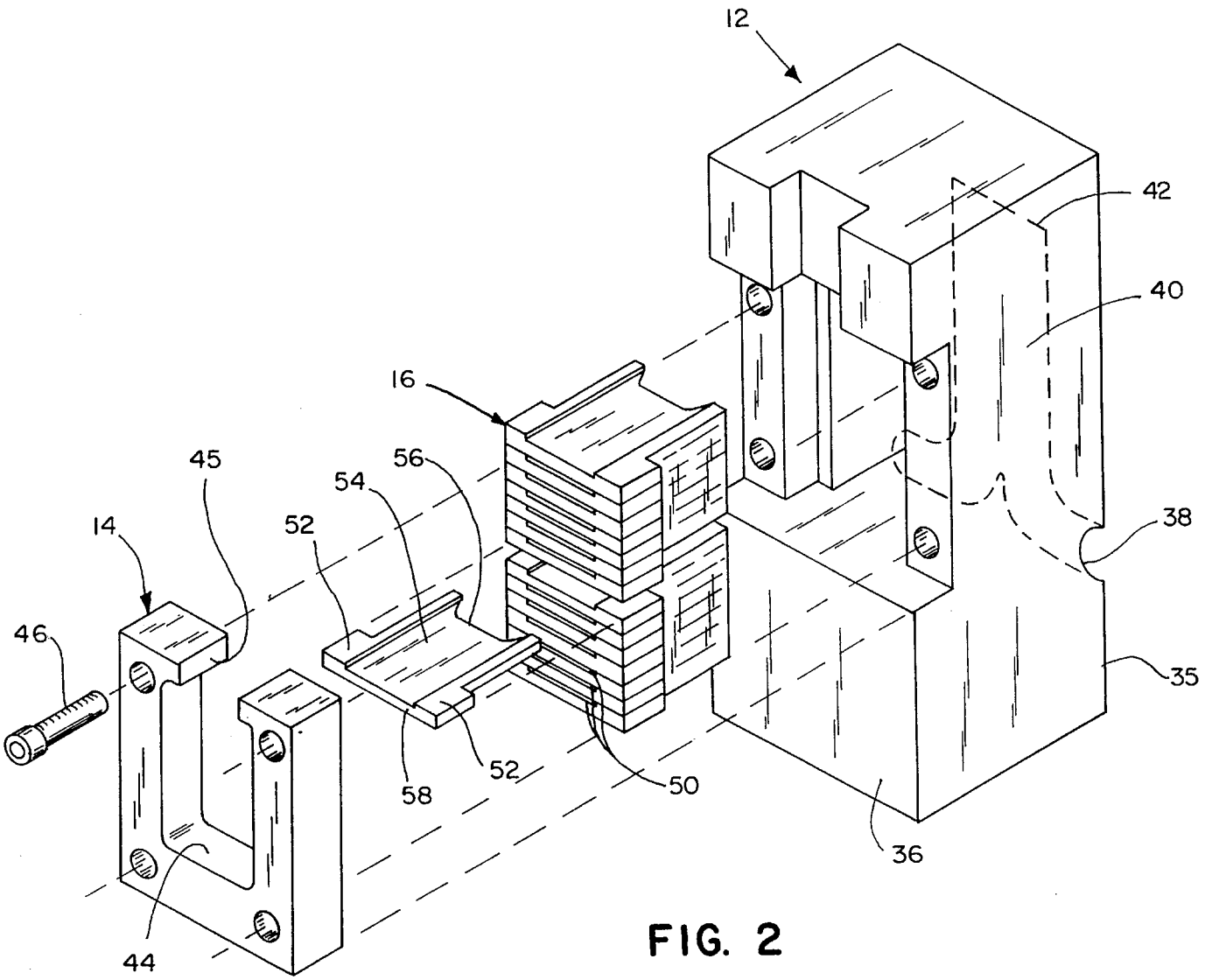
FIG. 2 is a perspective exploded view of the vent.
Figure 4:
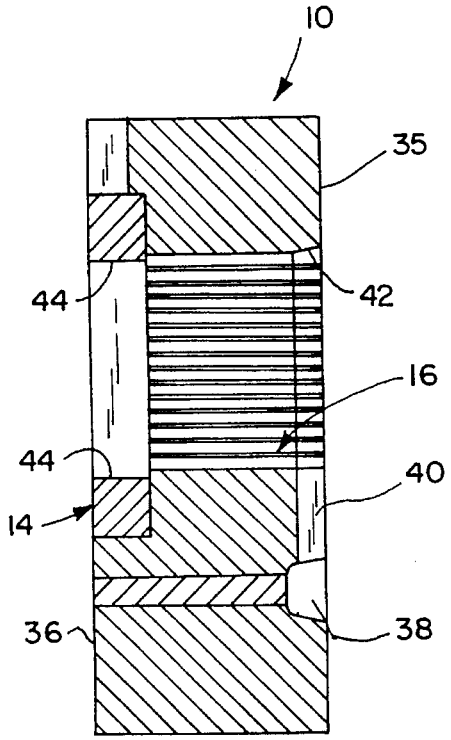
FIG. 4 is a side elevational view of the vent taken along line IV—IV in FIG. 3.
Figure 3:
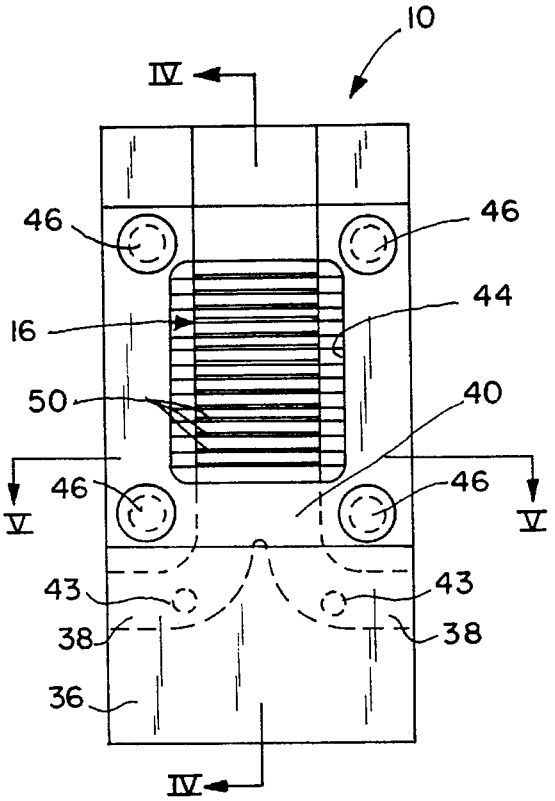
FIG. 3 is a front elevational view of the vent.

A die casting vent constructed in accordance with a preferred embodiment of the invention is illustrated in the drawings and generally designated 10. The vent includes a body 12, a retainer 14, and a plurality of plates 16. The retainer 14 retains the plates 16 within the body 12. Each plate 16 defines a gap or channel 18 along its full length. The gaps 18 are sufficiently wide to permit the passage of air but sufficiently narrow to prohibit the passage of molten metal.

FIG. 1 shows the vent 10 mounted within an ejector die 20. The ejector die defines a pathway or flow way 22 including an inlet 24, a manifold 26, a plurality of molds 28, a manifold 30, and an exit opening 32. The ejector die 20 is generally well-known to those skilled in the die casting art.

A shot sleeve (not shown) is operatively connected to the inlet 24 to introduce molten metal into the die. The manifold 26 distributes the molten metal to the various molds 28. The molds are shaped to define cavities defining the shape of the desired parts. The manifold 30 interconnects the molds 28 and the exit opening 32.

During a "shot" or "pour," molten metal flows through the inlet 24, through the manifold 26, through the molds 28, through the exhaust manifold 30, to the exit 32. In conventional arrangements, a valve (not shown) would be mounted in the exit opening 32 instead of the present vent 10. The valve could be either the Hodler System or the Turner System described above.

Figure 5:
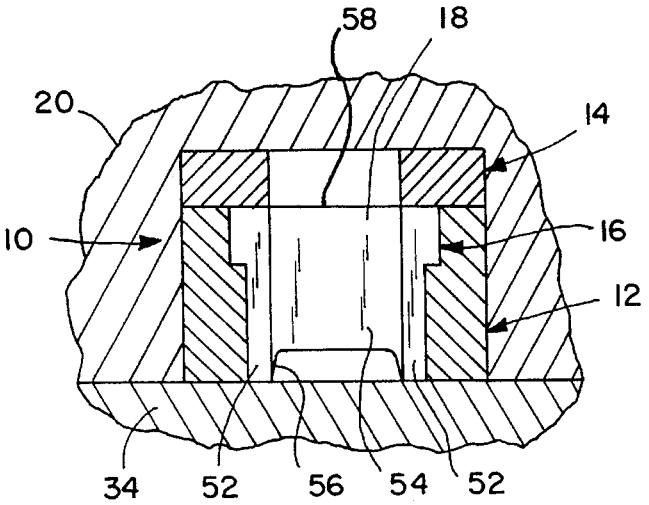
FIG. 5 is a sectional view taken along line V—V in FIG. 3 and including the ejector and cover dies.

As seen in FIG. 5, a die casting machine also includes a cover die 34, which is moveable with respect to the ejector die 20. The cover die seats against the ejector die 20 to complete definition of the molds 28. The cover die 34 also closes the flow passageways 22 including the inlet 24 and the manifolds 26 and 30.

The vent 10 is physically configured to fit within the exit opening 32. As noted above, the vent (FIGS. 2–5) includes a body 12, a retainer 14, and a plurality of stacked plates 16. The retainer 14 maintains the stacked plates 16 within the body 12.

The body 12 (FIGS. 2–5) is a single machined component. The body 12 includes a cover die face 35 and an ejector die face 36. The cover face 35 defines a pair of passageways 38 arranged to communicate with the exhaust manifold 30 (see FIG. 1). The passageways 38 join together into a passageway 40 running along the entire stack of plates 16. The passageway 40 terminates in a dead-end 42. Consequently, metal flowing through the passageways 38 and 40 can flow no further than the dead-end 42, and as explained below will not penetrate the stacked plates 16.

Ejector pins 43 are positioned within the metal passageways 38 as well as other locations within the ejector die. Ejector pins 43 enable the cast metal to be ejected from the vent when the cover and ejector dies are opened.

The retainer 14 also is a single machined component. The retainer 14 is generally a rectangular frame defining a central window running substantially the full height of the stacked plates 16. The retainer is "broken" at 45 to provide a vent from the window 44 to the environment. The retainer 14 is secured to the body 12 using four cap screws 46 or other suitable fasteners.

The body 12 and the retainer 14 together form a housing (unnumbered) for the vent 10. The housing retains the plates 16 in stacked configuration. The housing may be easily opened by removing the retainer 14 from the body 12, providing access to and removability of the plates 16.

The plates 16 are substantially identical to one another. Each of the plates 16 is generally hat-shaped. The hat-shaped plates are stacked one upon the other and positioned within the hat-shaped chamber in the body 12. Each plate 16 includes a pair of side portions 52 separated by a central portion 54. The side portions 52 of adjacent plates engage one another when the plates are stacked. Each of the central portions 54 defines a slot, groove, passage, or gap 50 in its undersurface. In the preferred embodiment, each slot is approximately one and one-quarter inch long and one-hundredth (0.010) inch wide.

Each plate 16 also includes a metal end 56 and an exit end 58. The metal end 56 includes an in-cut partially defining the passageway 40 to permit metal to flow upwardly along the stacked plates. The exit ends 58 open into and communicate with the window 44 in the retainer 14.

In the preferred embodiment, fifteen stacked plates are provided so that the total vent space is approximately 0.2 square inch (i.e. 1.24 inch times 0.01 inch times 15 plates). This space is adequate to vent most die casting dies. Of course, different amounts of vent space will be selected depending upon the die casting machine capacity.

The gap provided between the plates 16 is selected to be small enough to prohibit the flow of molten metal between the plates. The described vent is designed for aluminum alloys such as 380, 383,356, 357, and 390. These alloys are known to be incapable of penetrating gaps of one-hundredth (0.01) inch. Other gaps will of course be suitable depending upon the metal or metal alloy used in the die casting operation.

Operation

As the die casting machine is prepared for a pour or shot, the cover die 34 is closed on the ejector die 20. Metal is introduced into the closed dies through the inlet 24 and travels through the passageway 22. The metal fills the molds 28 and continues through the exhaust manifold 30 to the vent 10. As the metal follows this path, air is expelled through the vent 10 by the incoming metal. After the metal reaches the vent 10, it travels through the passageways 38 and 40 along the stacked plates. The metal stops flowing when it contacts the dead-end 42 (see FIG. 4) in the block 12. The gaps 50 in the plates 16 are sufficiently narrow to prevent the metal from passing between the plates and exiting the vent.

The vent 10 includes no moving parts and yet effectively both vents air and prevents metal from leaving the die casting machine. At the conclusion of the pour, the cover die 34 is removed from the ejector die 20 and the ejector pins 43 push the molded parts and metal within the passageways from the ejector die. Optionally, compressed air may be blown through the plates 16 to aid in pushing the metal off the vent plates.

As an option, a vacuum may be drawn on the exit ends 58 (see FIG. 5) of the plates to facilitate air evacuation during the shot. The use of a vacuum is generally well-known in both the Hodler and Turner Systems.

The above description is that of a preferred embodiment of the invention. Various alternations and changes can be made without departing from the spirit and broader aspects of the invention as defined in the appended claims, which are to be interpreted in accordance with the principles of patent law, including the doctrine of equivalents.

The embodiments of the invention in which an exclusive property or privilege is claimed are defined as follows:

1. A vent for a die casting apparatus for casting a molten metal, said vent comprising:

a body defining an inlet;

a retainer removably coupled to said body to define an outlet;

a plurality of stacked plates retained by said retainer within said body between said inlet and said outlet, each said plate including an inlet end adjacent said inlet and an outlet end adjacent said outlet, each said plate further including opposite flat and slotted sides, each said slotted side defining a slot extending from said inlet end to said outlet end leaving legs on either side thereof, each said slot being uniform in width and depth throughout its length, each said inlet end of each said plate defining an in-cut aligned with said other in-cuts allowing metal to flow through said aligned in-cuts in a direction perpendicular to said plates, said legs on each said slotted side of each said plate directly engaging said flat side of the adjacent plate, said slots of said stacked plates defining elongated gaps between said stacked plates, said gaps having a depth sufficiently narrow to prevent the passage of molten metal therethrough and sufficiently wide to permit the passage of air therethrough; and fastener means for fastening said retainer to said body, said fastener means being outside of said stacked plates.

2. A vent as defined in claim 1 wherein the depth of each of said gaps is less than approximately one-hundredth inch.

* * * * *